US009795270B2

(12) United States Patent
Casale

(10) Patent No.: US 9,795,270 B2
(45) Date of Patent: Oct. 24, 2017

(54) AUTOMATIC FREEZE PROTECTION FOR DISHWASHERS

(71) Applicant: Tom Casale, West Newbury, MA (US)

(72) Inventor: Tom Casale, West Newbury, MA (US)

( * ) Notice: Subject to any disclaimer, the term of this patent is extended or adjusted under 35 U.S.C. 154(b) by 0 days.

(21) Appl. No.: 14/545,946

(22) Filed: Jul. 10, 2015

(65) Prior Publication Data

US 2017/0007093 A1 Jan. 12, 2017

(51) Int. Cl.
*A47L 15/42* (2006.01)

(52) U.S. Cl.
CPC ..... *A47L 15/421* (2013.01); *A47L 2401/18* (2013.01); *A47L 2401/26* (2013.01); *A47L 2501/01* (2013.01); *A47L 2501/06* (2013.01)

(58) Field of Classification Search
None
See application file for complete search history.

(56) References Cited

U.S. PATENT DOCUMENTS 5,560,060 A 10/1996 Dausch et al.
5,984,194 A 11/1999 Francalanci
6,625,850 B2 9/2003 James
7,837,127 B2 11/2010 Kristinsson et al.
2010/0126604 A1 5/2010 Lund et al.
2011/0224834 A1 9/2011 Schleuthner
2014/0000724 A1* 1/2014 Park ..... E03B 7/08 137/78.1

FOREIGN PATENT DOCUMENTS

JP 03-016549 * 1/1991

OTHER PUBLICATIONS

English Machine Translation of KR10-2006-0039966.*

* cited by examiner

*Primary Examiner* — Michael Barr
*Assistant Examiner* — Jason Riggleman
(74) *Attorney, Agent, or Firm* — Philip M. Weiss; Weiss & Weiss

(57) ABSTRACT

A system for protecting a dishwasher from freezing using components within a dishwasher. The system comprising: a control circuit, a heating element, a water pump, drain hose, hot water supply, water valve, door sensor to determine whether dishwasher door is closed and a temperature sensor.

22 Claims, 1 Drawing Sheet

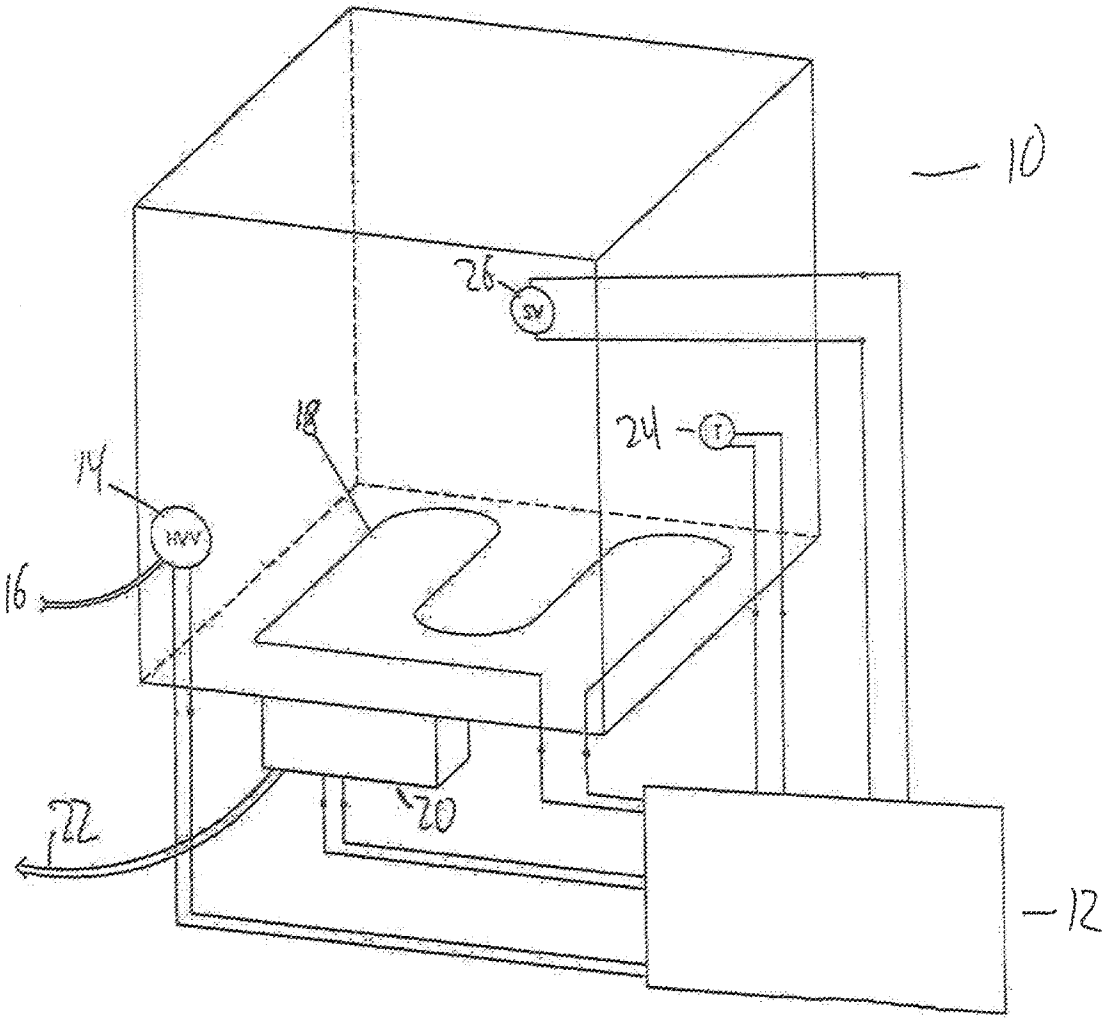
10
12
14
24
26
18
20
16
22

AUTOMATIC FREEZE PROTECTION FOR DISHWASHERS

FIELD OF THE INVENTION

The present invention relates to using components within a dishwasher to protect a dishwasher from freezing.

BACKGROUND OF THE INVENTION

Automatic dishwashers can be severely damaged when exposed to low temperatures for a duration long enough to cause water to freeze. These appliances have standing water present at all times in the pump assembly which is usually mounted at the bottom of the tub. Domestic water is also present in the supply line, while rinse water remains in the low point of the drain hose. All of these parts are subject to mechanical damage due to the expansion of water during a freeze. The pump, which is usually integral to the motor and/or transmission, is a particularly expensive component of an automatic dishwasher. Beyond the expense to replace whichever component is damaged, a significant labor charge is incurred to have a service technician remove the appliance from the cabinet, disassemble it, and replace it. Collateral damage to the home is also avoided as a cracked pump or water line can flood the environment after a thaw.

There are many reasons why a dishwasher could be exposed to temperatures which would cause the residual water to freeze. This is a particular concern in northern climates during the winter months.

Kitchens are often difficult to heat, due to the lack of baseboard for heat radiators. The need for appliances and cabinets along the walls, plus the need for various doorways into the room, can limit the linear feet available for baseboard heat.

Exterior doors are often placed in or near the kitchen which can allow cold air from outdoors to enter the room. Older homes may have poor or no insulation allowing cold air to penetrate the space behind an automatic dishwasher.

An automatic dishwasher could be installed on an outside wall, between base cabinets and under a countertop, which limits its exposure to the heated room. A dishwasher could be placed on a northern wall, which has limited sun and tends to be cold.

A kitchen may have the room heat reduced by a set-back thermostat for up to 12 hours over night between the evening meal and breakfast. A kitchen is often non-occupied between these hours.

The dishwasher maybe installed in a vacation home, such as a ski lodge or cabin, with the heat set to a low temperature during periods of non-occupancy. The unit may be installed in a pantry, garage, or storage area with limited or no heat.

U.S. Pat. No. 7,837,127 relates to a ventilation system for exchanging the air in a room with outside air. The system comprises a fine wire heat exchanger having a first channel and a second channel, which channels are in heat exchanging contact with each other, and wherein the first channel has an inlet connected to outside air and an outlet connected to the air in the room, and wherein the second channel has an inlet connected to the air in the room and an outlet connected to the outside air, balancing means for balancing the flow in both channels, such that the heat transfer is maximized.

U.S. Pat. No. 5,560,060 relates to a system and method for adjusting the operating cycle of a cleaning appliance. A controller having a decision system receives turbidity and temperature measurements from turbidity and temperature sensors and uses these measurements to adjust the operating cycle of the machine to the level of soil of the articles to be washed, the rate of soil removal, and the temperature of the water used for washing.

U.S. Pat. No. 5,984,194 relates to a valve for use in machines for washing, such as laundry machines and dishwashers, that includes a hollow valve body wherein a current of water flows, entering the valve body via at least one inlet of the valve, and at least one plug element for allowing and preventing the outflow of water from a corresponding outlet of the valve. The valve is connected to at least one temperature sensor device having an open and closed condition of an electrical connection and in that the sensor device has a preset trigger temperature which, when reached, causes the change from a state of closure to one of opening of the connection or vice versa.

U.S. Pat. No. 6,625,850 relates to a dishwasher sanitation cycle that includes sampling a temperature of rinse water inside a dishwasher, executing a heating cycle to keep water temperature at optimal levels, and executing a heat sum cycle to ensure that dishes are sanitized according to accepted standards.

US patent publication 2011/0224834 relates to a method for identifying operating conditions of a domestic appliance, a temperature of an operating agent of the appliance or of a component detected by a temperature sensor. The ambient temperature is detected by the temperature sensor before the programming mode, in an initialization phase. At least one reference temperature value is defined that represent a critical value for the programming mode of the appliance. The programming mode is prevented from beginning as a function of the comparison of the measured ambient temperature with at least one reference temperature value. The programming mode is prevented from beginning until the ambient temperature has reached a value that is in an acceptable range in comparison with the reference temperature value.

US patent publication 2010/0126604 relates to a demand type, multiple use, hot water distribution and freeze protection system and method that responds to the user's desire for hot water at a particular sink or fixture by delivering hot water rapidly to that fixture only, without running water down the drain. The system requires only one pump at the water heater, and does not require a dedicated hot water return line, but works with a dedicated line in retrofit applications. Circulating water in the plumbing system can also be used to protect plumbing from freeze damage. Each valve and activation device operates by transmitting a start command to the valve controller which sends the pump controller a start signal, the valve to open, hot water to circulate and the valve to close when the hot water arrives at the fixture preventing heated water from filling the cold water line.

SUMMARY OF THE INVENTION

The present invention relates to using components within a dishwasher to protect a dishwasher from freezing. Dishwasher appliances contain a heating element which is intended to dry the dishes after they have been cleaned and rinsed. Automatic dishwashers universally have a water pump at the base of the washing tub which ejects the waste water from the home's sewer line. Dishwashers are supplied hot water from the home's domestic plumbing system. A sensor to determine the appliance's door is closed is present to prevent flooding.

The present invention comprises a temperature sensing component and accompanying control circuit. It is an object of the present invention to mount the temperature sensor at the coolest expected location, such as the bottom rear of the appliance. The sensor activates the freeze protection function once the ambient temperature fails to be just above the freezing point, for a safety margin. It is an object of the present invention for the freezing point to be approximately 37 degrees F.

It is an object of the present invention for the control circuit that confirms the door is closed to admit hot water to the appliance for a period of time sufficient to allow heated water to travel from the home's water heater to the dishwasher.

It is an object of the present invention to have an activation period of approximately two (2) minutes to be sufficient, however, another duration can be designed.

It is an object of the present invention for the function of admitting hot water to be accomplished by the existing water valve/solenoid and controls used to operate an ordinary wash cycle. This will heat the dishwasher's supply line sufficiently to prevent freezing of this part of the system.

It is an object of the present invention for the hot water to be provided to be ejected into the drain hose via operation of the drain pump. It is an object of the present invention for this function to be accomplished by activating the pump via the control used to conclude a rinse cycle. This will heat the dishwasher's pump and drain line sufficiently to prevent freezing of this part of the system.

It is an object of the present invention for the heating element in the appliance to be energized using the existing thermostatic controls used for dish drying. The element remains in the heating mode until the temperature sensing component returns an ambient temperature. It is an object of the present invention for the ambient temperature to be approximately 45 degrees F. At the point the sensing component returns an ambient temperature the automatic freeze protection cycle is concluded.

Therefore, as shown above the local environment of the dishwasher has been heated a certain temperature above freezing. This will protect the appliance, for significant periods of time, from damage due to a freeze of standing water in the pump, drain, and/or supply line as there systems re-cool. The duration of protection will depend on the ambient conditions of the general area.

It is an object of the present invention for the system to reactivate if the threat of freezing recurs as indicated by a fall in ambient temperature, for example, to 37 degrees F.

It is an object of the present invention for the automatic dishwasher product to have the automatic freeze protection incorporated into the appliance in either a manual or fully automatic mode.

The manual mode requires the operator to engage the automatic freeze protection system if freezing temperatures are expected. The automatic mode operates in the background without user interaction to protect the appliance automatically.

It is an object of the present invention for the majority of the elements necessary to perform the automatic freeze protection to be present in household dishwashers. One additional requirement is the addition of a temperature sensor.

It is an object of the present invention for machines already equipped with an electronic control module, for the modification of the software to include the automatic freeze protection.

It is an object of the present invention for machines that are controlled using an electro-mechanical clock system to have the addition of a similar timer module to control the automatic freeze protection function.

The present invention combines the use of a temperature sensor wire and minor control implementation, for the user of a dishwasher appliance to have their dishwasher protected from expensive damage in the event the appliance is subject to freezing temperatures.

The present invention relates to a method for protecting a dishwasher from freezing comprising: activating a freeze protection function on a control circuit due to a temperature sensor detecting that ambient temperature is below freezing point. The control circuit senses whether the dishwasher door is closed. After sensing that the door is closed hot water is supplied from the home's domestic plumbing system sufficient for heated water to travel to the dishwasher. The hot water is supplied by existing water valve/solenoid and controls used to operate an ordinary wash cycle. The dishwasher's supply line is heated sufficiently to prevent freezing of this part of the dishwasher. Hot water is ejected via a drain hose from the drain pump. The hot water heats the dishwasher's pump and drain line sufficiently to prevent freezing of this part of the dishwasher. The components of the dishwasher are heated via a heating element until the temperature sensor returns an ambient temperature above freezing point. The freeze protection function concludes when the temperature sensor returns an ambient temperature above freezing point. The freeze protection function reactivates if the threat of freezing recurs as indicated by a fall in ambient temperature.

BRIEF DESCRIPTION OF THE FIGURES

FIG. 1 shows an internal view of an embodiment of the automatic freeze protection system for a dishwasher of the present invention.

DETAILED DESCRIPTION OF THE INVENTION

FIG. 1 shows dishwasher 10 having a controller 12 that is located within the dishwasher 10 but located outside the dishwasher for clarity. The dishwasher 10 has a hot water valve 14 that is connected to a domestic hot water supply 16. The dishwasher 10 has a heating element 18. The dishwasher 10 comprises a pump 20 that has a waste water discharge line 22. The controller 12 is connected to a temperature sensor 24, and is also connected to a door position switch 26. The controller 12 is also connected to the pump 20, hot water valve 14, and heating element 18.

In an embodiment, the temperature sensor 24 is mounted at the coolest expected location, such as the bottom rear of the appliance. The sensor 24 activates the freeze protection function of the controller 12 once the ambient temperature fails to be just above the freezing point, for a safety margin. In an embodiment, the freezing point is approximately 37 degrees F.

The control circuit 12 confirms the door is closed by door position switch 26 and admits hot water through hot water valve 14 to the dishwasher 10 for a period of time sufficient to allow heated water to travel from the home's water heater to the dishwasher 10.

In an embodiment, the control circuit has an activation period of approximately two (2) minutes to be sufficient, however, another duration can be designed.

The hot water valve 14 also admits hot water to operate an ordinary wash cycle. This will heat the dishwasher's supply line sufficiently to prevent freezing of this part of the system.

In an embodiment, the hot water is provided to be ejected into the drain hose 22 via operation of the drain pump 20. In an embodiment, this function is accomplished by activating the pump 20 via the control 12 which is also used to conclude a rinse cycle. This will heat the dishwasher's pump 20 and drain line 22 sufficiently to prevent freezing of this part of the system.

The heating element 18 in the appliance 10 is energized using the existing thermostatic controls used for dish drying. The element 18 remains in the heating mode until the temperature sensing component 24 returns an ambient temperature above the freezing point. In an embodiment, the ambient temperature is approximately 45 degrees F. At the point the sensing component 24 returns an ambient temperature above freezing point, the automatic freeze protection cycle is concluded.

The device of the present invention when activated heats the dishwasher to a certain temperature above freezing. This protects the appliance, for significant periods of time, from damage due to a freeze of standing water in the pump 20, drain, and/or supply line as their systems re-cool. The duration of protection will depend on the ambient conditions of the general area.

In an embodiment, the system of the present invention reactivates if the threat of freezing recurs as indicated by a fall in ambient temperature once again, for example, to 37 degrees F.

In an embodiment, the automatic dishwasher has the automatic freeze protection incorporated into the appliance in either a manual or fully automatic mode.

In an embodiment, the manual mode of the present invention requires the operator to engage the automatic freeze protection system if freezing temperatures are expected. The automatic mode operates in the background without user interaction to protect the appliance automatically.

The present invention combines the use of a temperature sensor and minor control implementation, for the user of a dishwasher appliance to have their dishwasher protected from the expensive damage in the event the appliance is subjected to freezing temperatures.

The invention claimed is:

1. A system for protecting a dishwasher from freezing comprising:
- a control unit;
- a heating element;
- a water pump;
- drain hose;
- hot water supply;
- water valve;
- door sensor to determine whether dishwasher door is closed;
- temperature sensor;
- said sensor activates a freeze protection function of said control circuit once ambient temperature falls to be above freezing;
- said control circuit confirms said door is closed by said door sensor, and admits hot water from said hot water supply to said dishwasher for a period of time sufficient for heated water to travel from home's water heater to said dishwasher, so local environment of said dishwasher is heated to a certain temperature above freezing;
- said heating element remains in heating mode until said temperature sensing component returns an ambient temperature above freezing point.

2. The system of claim 1 wherein said system uses components within a standard Dishwasher to protect said dishwasher from freezing.

3. The system of claim 1 wherein said heating element also dries dishes after they have been cleaned and rinsed.

4. The system of claim 1 wherein said water pump ejects waste water to a home's sewer line.

5. The system of claim 1 wherein said hot water is from a home's domestic plumbing system.

6. The system of claim 1 wherein said temperature sensor is mounted in or on said dishwasher.

7. The system of claim 1 wherein said freezing point is approximately 37 degrees F.

8. The system of claim 1 wherein said system has an activation period of approximately two (2) minutes to be sufficient.

9. The system of claim 1 wherein function of admitting hot water for freeze protection is accomplished by existing water valve/solenoid and controls used to operate an ordinary wash cycle.

10. The system of claim 9 wherein said system heats dishwasher's supply line sufficiently to prevent freezing of this part of said system.

11. The system of claim 1 wherein said hot water provided is ejected into said drain hose via operation of said pump.

12. The system of claim 11 wherein function of ejecting hot water is accomplished by activating said pump via control used to conclude a rinse cycle.

13. The system of claim 12 wherein said hot water heats said pump and drain line sufficiently to prevent freezing of this part of said system.

14. The system of claim 1 wherein said heating element is energized using existing thermostatic controls used for dish drying.

15. The system of claim 1 where at point said temperature sensor returns an ambient temperature above freezing point, automatic freeze protection cycle is concluded.

16. The system of claim 1 wherein said freeze protection protects said dishwasher, for significant periods of time, from damage due to a freeze of standing water in said pump, said drain, and/or said supply line as systems re-cools.

17. The system of claim 1 wherein said system reactivates if threat of freezing recurs as indicated by a fall in ambient temperature below a certain temperature.

18. The system of claim 1 wherein said freeze protection function is incorporated in said dishwasher in a manual mode.

19. The system of claim 1 wherein said freeze protection function is incorporated in said dishwasher in a fully automatic mode.

20. The system of claim 18 wherein said manual mode requires operator to engage said freeze protection function if freezing temperatures are expected.

21. The system of claim 19 wherein said automatic mode operates without user interaction to protect said dishwasher automatically.

22. A system for protecting a dishwasher from freezing comprising:
- a controller located inside said dishwasher;
- said dishwasher comprising a hot water valve connected to a domestic hot water supply;
- a heating element located inside said dishwasher;
- a pump having a waste water discharge line;
- door position switch;
- said controller is connected to a temperature sensor, door position switch, pump, hot water valve, and heating element;

said temperature sensor activates a freeze protection function of said controller once ambient temperature falls to be just above freezing point;

said control circuit confirms door of dishwasher is closed by said door position switch and admits hot water through hot water valve to said dishwasher for a period of time sufficient for heated water to travel from home's water heater to said dishwasher;

said hot water valve admits hot water to operate an ordinary wash cycle, heating dishwasher's supply line sufficiently to prevent freezing of this part of said system;

hot water provided is ejected into said drain hose via operation of said pump;

said pump activated via said control which is also used to conclude a rinse cycle;

said hot water heats said pump and drain line sufficiently to prevent freezing of this part of said system;

said heating element is energized using existing thermostatic controls used for dish drying;

said heating element remains in heating mode until said temperature sensor returns an ambient temperature above freezing point;

said controller when activated heats dishwasher to a certain temperature above freezing.

* * * * *